US010721578B2

(12) United States Patent
McDowell et al.

(10) Patent No.: US 10,721,578 B2
(45) Date of Patent: Jul. 21, 2020

(54) SPATIAL AUDIO WARP COMPENSATOR

(71) Applicant: Microsoft Technology Licensing, LLC, Redmond, WA (US)

(72) Inventors: Brian McDowell, Redmond, WA (US); Philip Andrew Edry, Seattle, WA (US); Robert Norman Heitkamp, Sammamish, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 24 days.

(21) Appl. No.: 15/606,375

(22) Filed: May 26, 2017

(65) Prior Publication Data

US 2018/0197551 A1 Jul. 12, 2018

Related U.S. Application Data

(60) Provisional application No. 62/443,328, filed on Jan. 6, 2017.

(51) Int. Cl.
*H04S 7/00* (2006.01)

(52) U.S. Cl.
CPC ..... *H04S 7/30* (2013.01); *H04S 2400/11* (2013.01); *H04S 2400/13* (2013.01)

(58) Field of Classification Search
CPC ..... H04S 2400/11; H04S 2420/11; H04S 2420/01; H04S 3/002; H04S 3/008; H04S 7/30; H04S 7/308; G10L 19/008; G10L 19/173; G06F 3/162; H04R 5/02; G06T 19/006; G06T 3/00
USPC ..... 348/E13.026, E7.085, 51; 381/307, 17, 381/22, 23, 300, 310, 77; 382/254; 704/E15.001, 200.1, 246, 500, 501, 502, 704/503; 709/234; 725/32
See application file for complete search history.

(56) References Cited

U.S. PATENT DOCUMENTS 6,694,033 B1 2/2004 Rimell et al.
7,720,212 B1 5/2010 Jouppi et al.
8,374,365 B2 2/2013 Goodwin et al.
(Continued)

OTHER PUBLICATIONS

Mehra et al., "Wave-based sound propagation in large open scenes using an equivalent source formulation", Apr. 1, 2013 ACM Transactions on Graphics, vol. 32 Issue 2, Apr. 2013; Article No. 19.*
(Continued)

*Primary Examiner* — Duc Nguyen
*Assistant Examiner* — Alexander L Eljaiek
(74) *Attorney, Agent, or Firm* — Arent Fox LLP

(57) ABSTRACT

Methods and devices for correcting warping in spatial audio may include identifying a geometric transform that defines a geometric warping between a first spatial geometric model that represents how sound is produced in a first volumetric space and a second spatial geometric model that represents how sound is produced in a second volumetric space different from the first volumetric space. The methods and devices may include determining an inverse of the geometric transform that compensates for the geometric transform. The methods and devices may include applying the inverse of the geometric transform to a first location in the first spatial geometric model by mapping the first location to a second location in the second spatial geometric model to correct for the geometric warping.

20 Claims, 12 Drawing Sheets

(56) References Cited

U.S. PATENT DOCUMENTS

| | | | | |
|---|---|---|---|---|
| 9,338,574 | B2 | 5/2016 | Jax et al. | |
| 2008/0025639 | A1* | 1/2008 | Widdowson | G06K 9/3208 382/284 |
| 2008/0101711 | A1 | 5/2008 | Kalker et al. | |
| 2009/0147975 | A1 | 6/2009 | Horbach et al. | |
| 2012/0194516 | A1* | 8/2012 | Newcombe | G06T 17/00 345/420 |
| 2013/0083173 | A1* | 4/2013 | Geisner | G06F 3/013 348/51 |
| 2014/0016802 | A1* | 1/2014 | Sen | H04S 3/002 381/307 |
| 2014/0270320 | A1 | 9/2014 | O'polka | |
| 2015/0131824 | A1 | 5/2015 | Nguyen et al. | |
| 2015/0189455 | A1 | 7/2015 | Donaldson | |

OTHER PUBLICATIONS

"International Search Report and Written Opinion Issued in PCT Application No. PCT/US2017/068846", dated Mar. 9, 2018, 11 Pages.

Gallo, et al., "3D-Audio Matting, Post-editing and Re-rendering from Field Recordings", In Journal of EURASIP Journal on Advances in Signal Processing, Dec. 1, 2007, pp. 1-14.

Farina, et al., "Spatial Equalization of Sound Systems in Cars", In 15th International Conference on Audio Engineering Society, Oct. 1, 1998, 17 pages.

* cited by examiner

SPATIAL AUDIO WARP COMPENSATOR

RELATED APPLICATION

This application claims priority to U.S. Application No. 62/443,328 titled "Spatial Audio Warp Compensator," filed Jan. 6, 2017, which is incorporated herein by reference in its entirety.

BACKGROUND

The present disclosure relates to spatial audio, and more particularly, to the use of spatial audio on a computer device.

Spatial audio provides the ability to place sounds about the listener using volumetric coordinates. For example, the listener may be placed at an origin point represented as (x, y, z), where x=0, y=0 and z=0 or (0, 0, 0). A sound can be placed at any position represented as a combination of values of (x, y, z).

There are various methods of rendering spatial audio such that the listener experiences the sound as originating from the position specified, however, some spatial rendering technologies cannot maintain relative geometric positioning and velocity due to geometric distortions (e.g., warping) introduced in the rendering process. For example, spatial rendering technologies that rely on physical speakers placed around the listener to achieve the specialization effect can exhibit spatial audio warping as a physical room geometry, e.g., the relative locations and number of the physical speakers, in which the spatial audio content is rendered can be different from the geometry used to create the spatial audio content. Because the physical room geometry is not known when content is authored, the spatial audio content must be authored to a standardized or normalized geometry that abstracts the physical room into a known layout or geometry (referred to as a normalized room or spatial geometry).

In particular, a spatial audio renderer maps the normalized room geometry into the physical room geometry. The conversion from the normalized room geometry to the physical room geometry can result in a warping in geometric space. For instance, if the author animated a sound in a perfect circle about the listener at a constant velocity based on the normalized room geometry, then the result generated by the spatial audio renderer in a differently configured physical room geometry would not be a perfect circle and the velocity would not be constant, resulting in a warping of both space and time.

Thus, there is a need in the art for improvements in spatial audio.

SUMMARY

The following presents a simplified summary of one or more implementations of the present disclosure in order to provide a basic understanding of such implementations. This summary is not an extensive overview of all contemplated implementations, and is intended to neither identify key or critical elements of all implementations nor delineate the scope of any or all implementations. Its sole purpose is to present some concepts of one or more implementations of the present disclosure in a simplified form as a prelude to the more detailed description that is presented later.

One example implementation relates to a computer device. The computer device may include a memory to store data and instructions, a processor in communication with the memory, and an operating system in communication with the memory and processor. The operating system may be operable to identify a geometric transform that defines a geometric warping between a first spatial geometric model that represents how sound is produced in a first volumetric space and a second spatial geometric model that represents how sound is produced in a second volumetric space different from the first volumetric space, determine an inverse of the geometric transform that compensates for the geometric transform, and apply the inverse of the geometric transform to a first location in the first spatial geometric model by mapping the first location to a second location in the second spatial geometric model to correct for the geometric warping.

Another example implementation relates to a method for correcting warping in spatial audio. The method may include identifying, at an operating system executing on a computer device, a geometric transform that defines a geometric warping between a first spatial geometric model that represents how sound is produced in a first volumetric space and a second spatial geometric model that represents how sound is produced in a second volumetric space different from the first volumetric space. The method may also include determining, at the operating system, an inverse of the geometric transform that compensates for the geometric transform. The method may also include applying the inverse of the geometric transform to a first location in the first spatial geometric model by mapping the first location to a second location in the second spatial geometric model to correct for the geometric warping.

Another example implementation relates to computer-readable medium storing instructions executable by a computer device. The computer-readable medium may include at least one instruction for causing the computer device to identify a geometric transform that defines a geometric warping between a first spatial geometric model that represents how sound is produced in a first volumetric space and a second spatial geometric model that represents how sound is produced in a second volumetric space different from the first volumetric space. The computer-readable medium may include at least one instruction for causing the computer device to determine an inverse of the geometric transform that compensates for the geometric transform. The computer-readable medium may include at least one instruction for causing the computer device to apply the inverse of the geometric transform to a first location in the first spatial geometric model by mapping the first location to a second location in the second spatial geometric model to correct for the geometric warping.

Additional advantages and novel features relating to implementations of the present disclosure will be set forth in part in the description that follows, and in part will become more apparent to those skilled in the art upon examination of the following or upon learning by practice thereof.

DETAILED DESCRIPTION

Figure 1C:
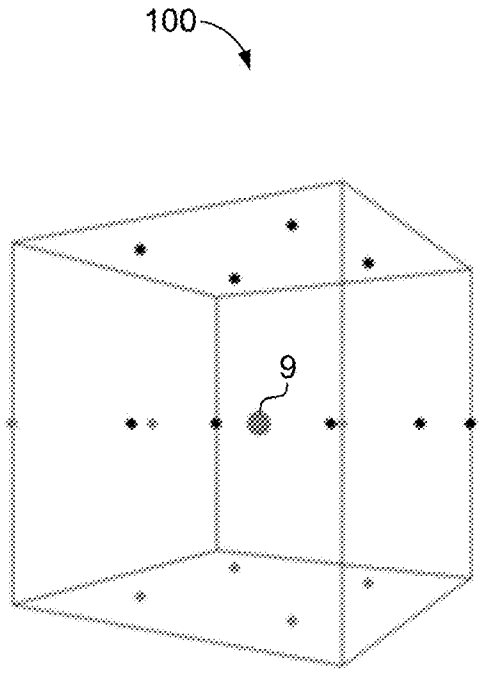
FIGS. 1A-1C illustrate a top view (with front side at the top), a front side view, and a three-dimensional (3D) front perspective view, respectively, of an example normalized room geometry with visible dots representing placement of static audio objects within the volumetric space in accordance with an implementation of the present disclosure.
Figure 1C:
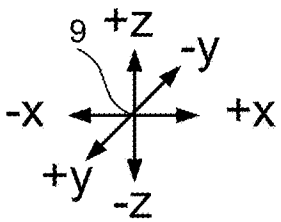

The present disclosure provides systems and methods for compensating for warping, such as geometric and/or velocity (e.g., space and/or time) warping, during authoring of spatial audio content. The systems and methods provide a first spatial geometric model that represents how sound is produced relative to a fixed position within the first spatial geometric model. In addition, the systems and methods provide a differently-configured second spatial geometric model that represents how sound is produced relative to the fixed position within the second spatial geometric model. The models may represent a physical location and/or a virtual location. In an implementation, the systems and methods may allow a user to specify the spatial geometric models that represent the volumetric space where audio will be consumed. For example, a user may input a room size, a number of static audio objects to place in the room, a number of dynamic audio objects to place in the room, and/or locations of the static and dynamic audio objects in the room.

The systems and methods may compensate for geometric and velocity warping that may occur during rendering of spatial audio content authored due to a difference between the first spatial geometric model that the author uses to create the spatial audio content and the second spatial geometric model that represents how the sound will be produced when rendered. The systems and methods may compute a three dimensional (3D) transformation that defines a geometric warping resulting from the differences between spatial geometric models and may encode an inverse of the geometric warping into one of the spatial geometric models. Thus, based on applying of the inverse geometric model, during rendering of the spatial audio content in the second spatial geometric model, the original author-intended geometry of the spatial audio content associated with the first spatial geometric model is restored. The systems and methods may efficiently map between multiple spatial geometries in a single mapping pass.

The present solution may be utilized with any spatial audio rendering technology that uses physical speakers placed around the listener to achieve a specialization effect where the listener experiences the sound as originating from specified positions. Because the physical room geometry may not be known when the spatial audio content is authored, the content must be authored to a normalized room geometry that abstracts the room into a known layout.

When authoring spatial audio content, there are at least two types of audio objects defined within the volumetric space, a static audio object and a dynamic audio object. A static audio object represents a sound that will play back through a specific speaker (or audio channel). For example, spatial audio content rendered to a static audio object defined as Front-Right will result in audio coming out of the Front-Right speaker, and only that speaker, if that speaker is present at the rendering stage. If the speaker is not present, the renderer will balance the sound across adjacent speakers, referred to as panning.

A dynamic audio object represents a sound that will play back not through a specific speaker/channel, but instead will playback though any and all channels necessary to achieve the spatial illusion, based on its position in the volumetric space. A dynamic audio object may be placed anywhere in volumetric space and sound may be rendered out of the physical speakers represented by the static audio objects. Which static audio objects are needed to "project" the dynamic audio object into the volumetric space, and the corresponding amount of signal power needed, may be mathematically determined by, for example, a spatial renderer.

Generally, the following criteria may be associated with a normalized room geometry in order to work as a spatial audio volumetric coordinate system. First, every static audio object supported by the spatial encoding format must be represented in the normalized room geometry. Because the normalized room geometry has no knowledge of what physical speaker may or may not be present in the physical room geometry, all speakers are assumed to be present. Second, for each static audio object, there must be a specified position in the volumetric coordinate system (e.g., in x, y, z coordinates), such that any dynamic object positioned at the same location will render audio only though the corresponding speaker.

When spatial audio content is authored, there may be no knowledge of the physical room geometry in which sound may be rendered. As such, an author creates spatial audio content relative to the normalized room geometry (e.g., a known layout for the room). The spatial audio renderer (e.g., a spatial encoder) maps the normalized room geometry into the physical room geometry in which sound is to be rendered.

In some cases, the conversion from a normalized room geometry to the physical room geometry results in a warping in geometric space, which, in turn, results in temporal warping of animated dynamic objects traversing the warped geometry over time. For example, the normalized room geometry may specify a listener position at origin (0, 0, 0) and a front-left static object at position (−1, 1, 0). In the physical room, assume the listener is facing forward toward a front-center static object at position (0,−1, 0) and the relative angle to the listener of the front-left static object is 45 degrees to the left relative to the listener, in the same horizontal plane as the listener. For rendering spatial audio content in the physical room geometry, however, the front-left speaker corresponding to the front left static object in the normalized room geometry has a recommended placement of 30 degrees relative to the listener. As such, there may be a relative warping of 15 degrees from what was authored versus what will be heard by the listener. When applying the warping to each speaker separately, variable warping may occur. If the author animated a sound in a perfect circle about the listener at a constant velocity, the result may not be a perfect circle and the velocity may not be constant. Thus, a warping in both space and time may occur (e.g., a space-time warping). The present solution compensates for this warping by applying an inverse of the warping to enable the spatial audio content to be rendered in the physical room geometry at the intended position relative to the listener as defined in the normalized room geometry that was used to author the spatial audio content.

Figure 1B:
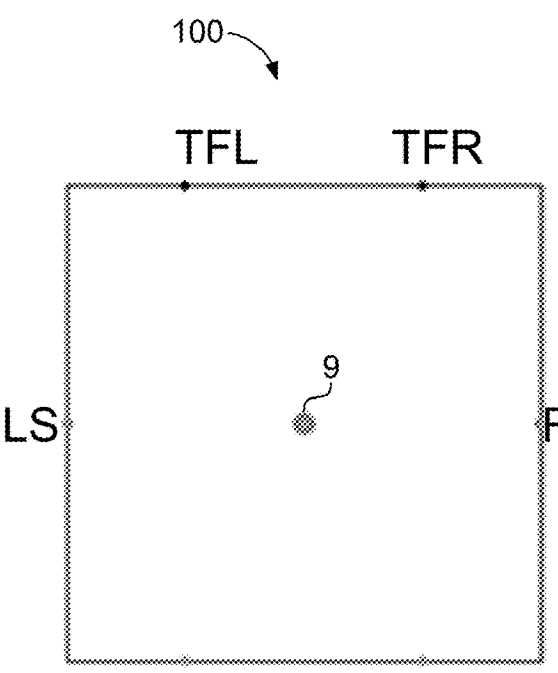
Figure 1B:
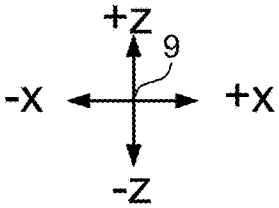
Figure 1A:
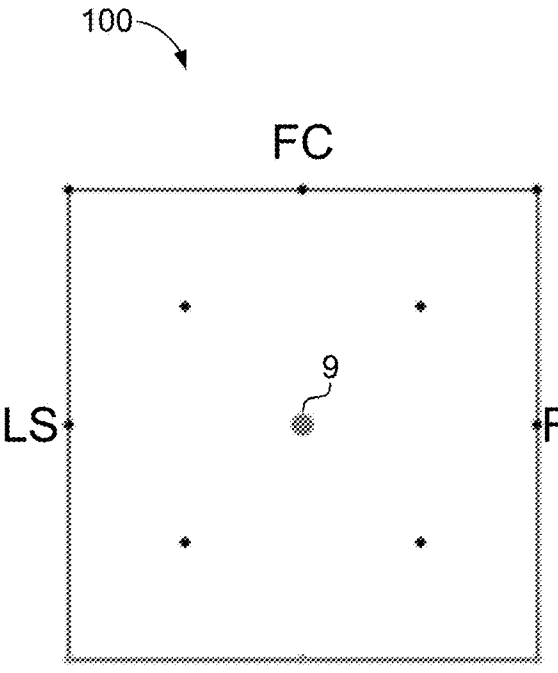
Figure 1A:
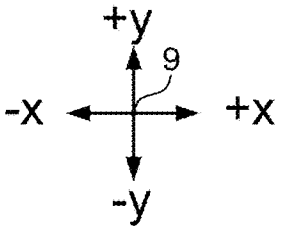

Referring now to FIGS. 1A-1C, example views of a normalized room geometry 100 (which may be referred to as an authoring model) represent a room which is 2 units wide, 2 units deep, and 2 units tall, and having a listener 9 in the center of the room at geometric position (0,0,0). A distance to all "walls" of the room from listener is 1 unit. For example, the model for the normalized room geometry 100 may include static audio objects such as one or more Front-Center (FC) speakers positioned at location (0,1,0), one or more Back-Center (BC) speakers positioned at location (0,−1,0), one or more Left-Side (LS) speakers positioned at (−1,0,0), and one or more Right-Side (RS) speakers positioned at (1,0,0). In addition, the model for normalized room geometry 100 may place static audio objects such as one or more Front-Left (FL) speakers in the corner at (−1,1,0) and one or more Front-Right (FR) speakers in the corner at (1,1,0), and so on. The model for the normalized room geometry 100 may also place static audio objects such as one or more upper and lower speakers (TopFrontLeft, TopFrontRight, TopBackLeft, TopBackRight, and corresponding four bottom speakers) at the center of each of the four ceiling and lower quadrants. The normalized room geometry 100 may vary from encoder to encoder.

Figure 2C:
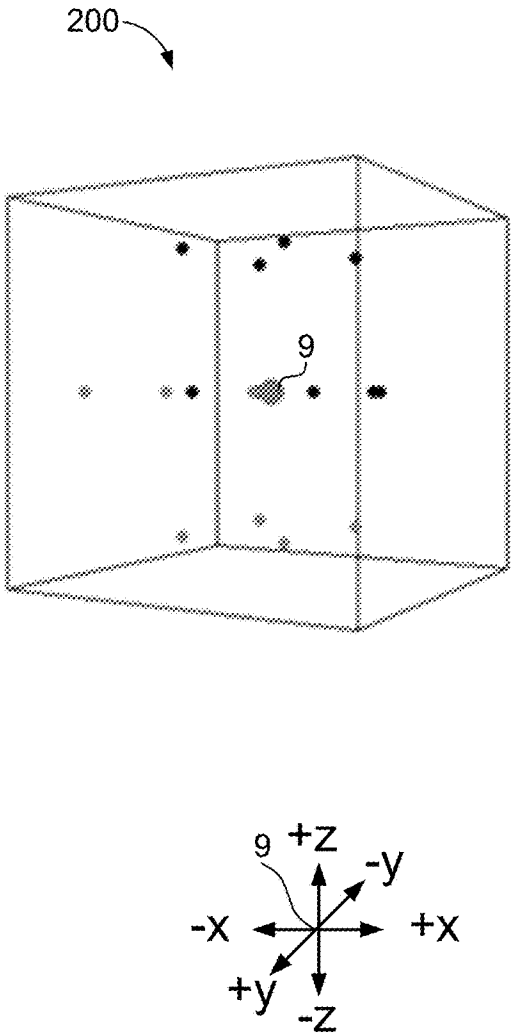
FIGS. 2A-2C illustrate a top view (with front side at the top), a front view, and a 3D front perspective view, respectively, of an example physical room geometry in accordance with an implementation of the present disclosure.
Figure 2B:
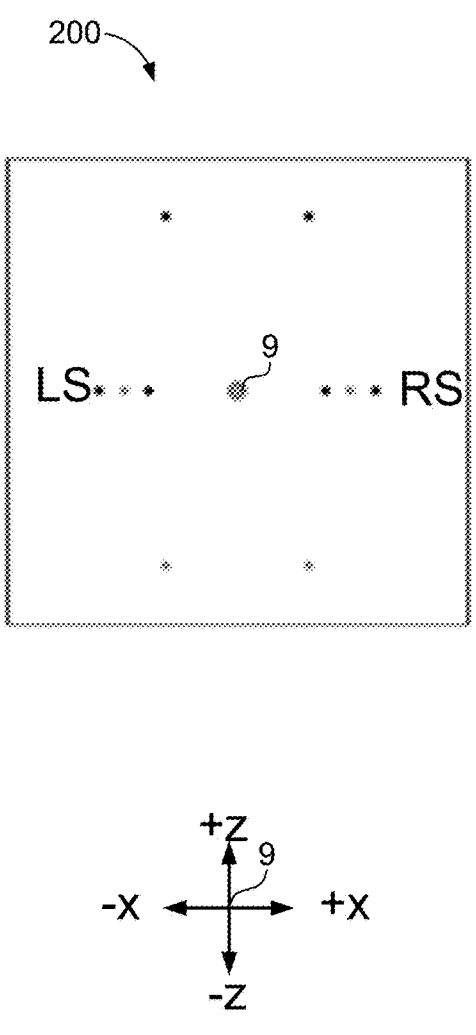
Figure 2A:
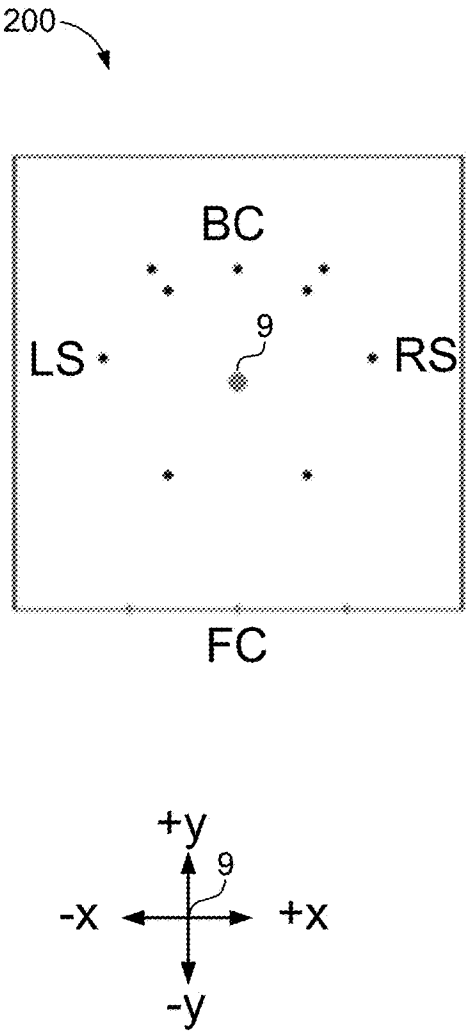

Referring now to FIGS. 2A-2C, an example of a physical room geometry 200 (which may be referred to as a rendering model) in accordance with an implementation includes different positioning of each static audio object relative to the listener 9, as compared to the normalized room geometry 100 of FIGS. 1A-1C. The geometric configuration of physical room geometry 200 demonstrate one of many possible differences in layout of the geometry between the physical room geometry and the normalized room geometry. In particular, any difference between any of the static audio objects between the two geometries can cause space and time warping of spatial audio content. For example, as compared to the normalized room geometry 100 of FIGS. 1A-1C, the physical room geometry 200 may have static audio objects such as one or more front center speakers relatively closer to the listener 9, and one or more front left speakers and front right speakers at different relative angles (e.g., placed at +/−30 degrees, respectively, relative to the listener 9), and one or more left side and right side speakers, respectively, in different relative positions with respect to the listener 9. In addition, the physical room geometry 200 may have static audio objects such as one or more ceiling and floor speakers positioned closer to the listener 9 as compared to the normalized room geometry 100 of FIGS. 1A-1C. Also, in the physical room geometry 200, static audio objects such as one or more back speakers (e.g., back center (BC), back left, and back right) may be positioned physically further away from and/or at different angles relative to the listener 9. The placement of each static audio object in the physical room geometry 200 may be based on, for example, recommended speaker positions and angles of speakers by a specific spatial audio encoder technology for an "optimal audio experience."

Geometric warping in the rendering of spatial audio content may be caused by the difference between the normalized room geometry 100 of FIGS. 1A-1C (e.g., the authoring model) and the physical room geometry 200 of FIGS. 2A-2C (the rendering model).

Figure 3A:
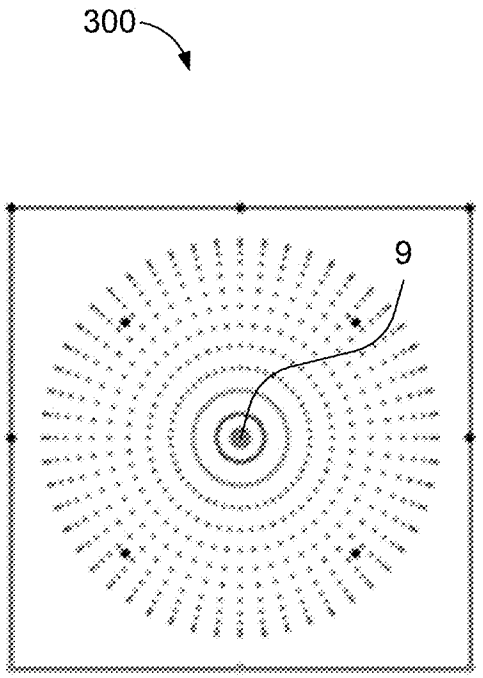
FIGS. 3A-3C illustrate a top view, a front view, and a 3D front perspective view, respectively, of a collection of volumetric points arranged to form the same of a sphere around a listener in an example physical room geometry in accordance with an implementation of the present disclosure.
Figure 3B:
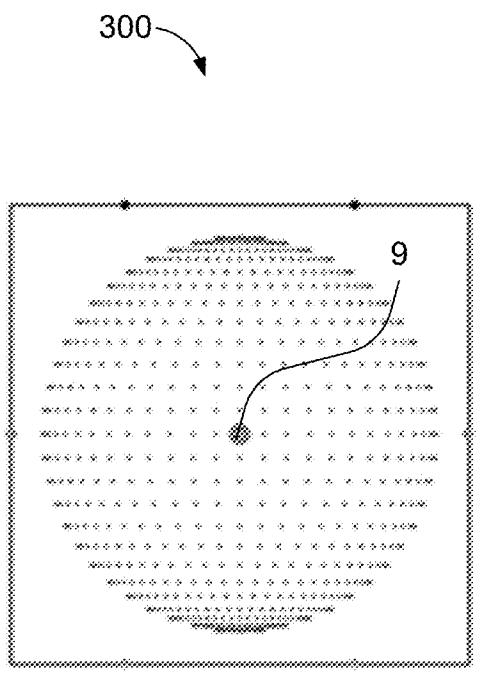
Figure 3C:
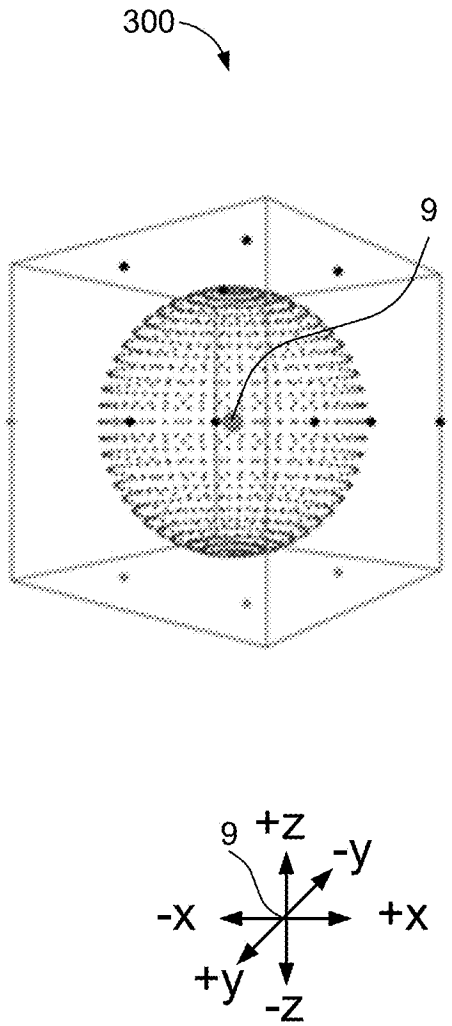

For example, spatial audio content in the form of a sphere 300 about the listener 9 authored in the normalized room geometry 100 is illustrated in FIGS. 3A-3C.

Figure 4C:
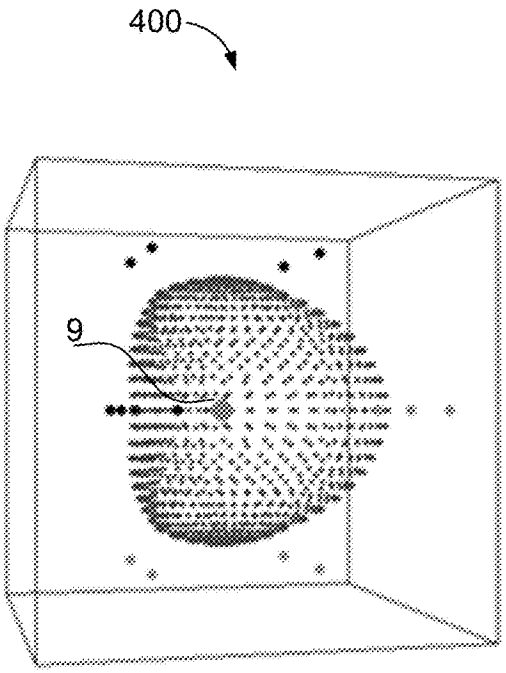
FIGS. 4A-4C illustrate a top view, a back side view, and a 3D back perspective view, respectively, of example geometric warping of spatial audio content authored for an example normalized room geometry but rendered in an example physical room geometry different from the example normalized room geometry, in accordance with an implementation of the present disclosure.
Figure 4C:
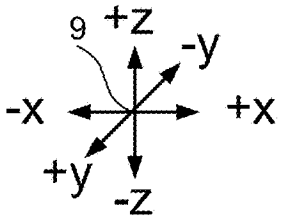
Figure 4B:
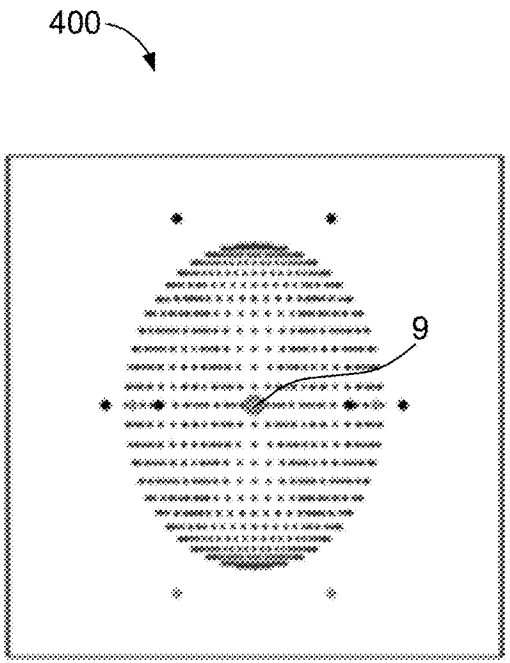
Figure 4B:
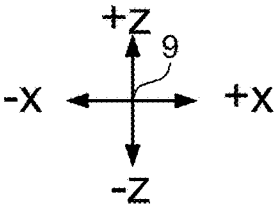
Figure 4A:
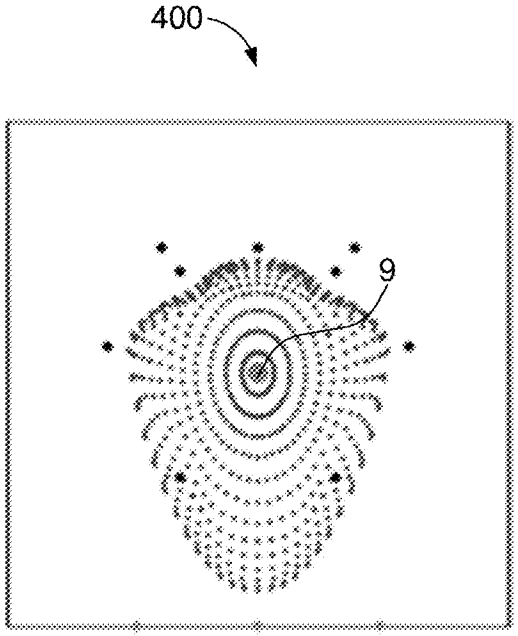
Figure 4A:
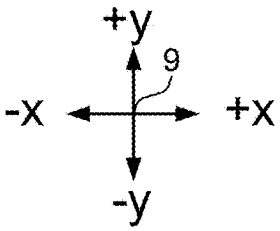

In contrast, FIGS. 4A-4C, illustrate an example of a geometric warping 400 that may occur when rendering the sphere 300 authored in the normalized room geometry 100 in a room with physical room geometry 200. For instance, when mapping the x, y, z coordinates from the normalized room geometry 100 to the physical room geometry 200, geometry warping may occur in order to guarantee that a location of each static audio object in the normalized room geometry 100 maps perfectly onto the corresponding static audio object in the physical room geometry 200. Thus, rather than producing the intended sphere 300 about the listener 9, rendering of this example of the spatial audio content in the physical room geometry 200 will result in the geometric warping 400.

The systems and methods of the present disclosure compensate for geometric and velocity warping (or, space and/or time warping) that may occur due to differences between an authoring model and a rendering model, by encoding an inverse of the warping into the normalized room geometry used for authoring the spatial audio content. As such, the author would not author spatial audio content to the normalized room geometry, but instead authors spatial audio content to an expected physical room geometry. An expected physical room geometry may be obtained, for example, via documentation provided by a spatial audio encoder, or computed based on received measurements of warping of a known output. In addition, an expected physical room geometry may be based on receiving, e.g., from an end user via a user interface, information that accurately describes the geometric room (e.g., the speaker geometry) in which the spatial audio content will be rendered.

Figure 5A:
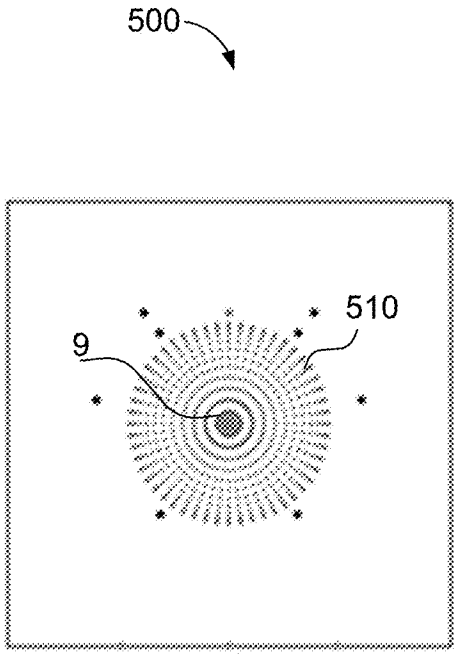
FIGS. 5A-5C respectively illustrate a top view of the expected room geometry with a rendered sphere, a top view onto the normalized room geometry with inverse projection of the sphere into the normalized geometry, and a 3D front-right perspective view of the inverse projection of the sphere into the normalized geometry, respectively, in accordance with an implementation of the present disclosure.
Figure 5B:
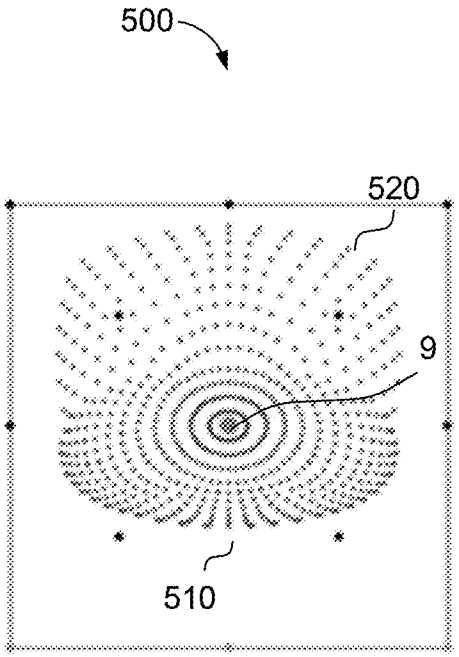
Figure 5C:
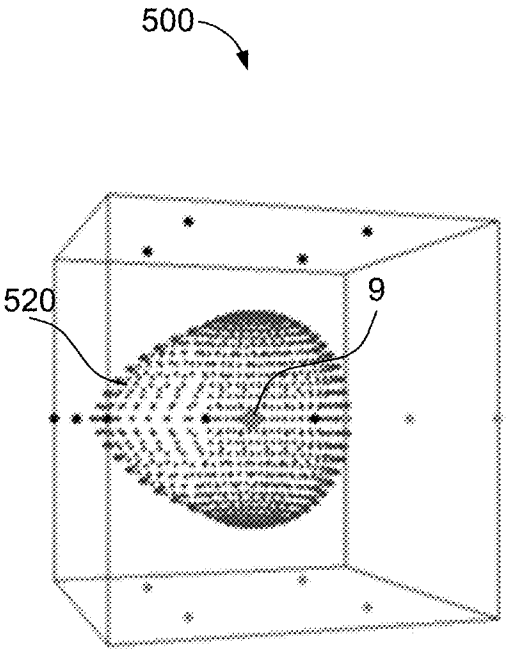

Referring now to FIGS. 5A-5C, FIG. 5A includes an example of a room with the expected physical room geometry 500 and an intended spatial audio content rendering 510, e.g., a rendered sphere, representing a result of the present solution. FIGS. 5B and 5C includes the normalized room geometry 100 modified according to the present disclosure to include an inverse projection 520 (e.g., the 3D transformation, or the inverse of the geometric warping) of the intended spatial audio content rendering 510, e.g., the sphere, into the normalized geometry 100. This modification enables the expected physical room geometry 500 to properly and accurately render the intended spatial audio content rendering 510, e.g., with a substantial reduction or elimination of time and/or space warping of the spatial audio content.

The methods and systems of the present disclosure may compute the 3D transformation that defines the geometric warping that may occur between the expected physical room geometry and the normalized geometry and may encode the 3D transformation (e.g., an inverse of the geometric warping, or inverse geometric transform) into the normalized room geometry. Thus, geometric models for spatial audio content can be generated to enable rendering the original authored intended geometry in a given physical room geometry.

Figure 6:
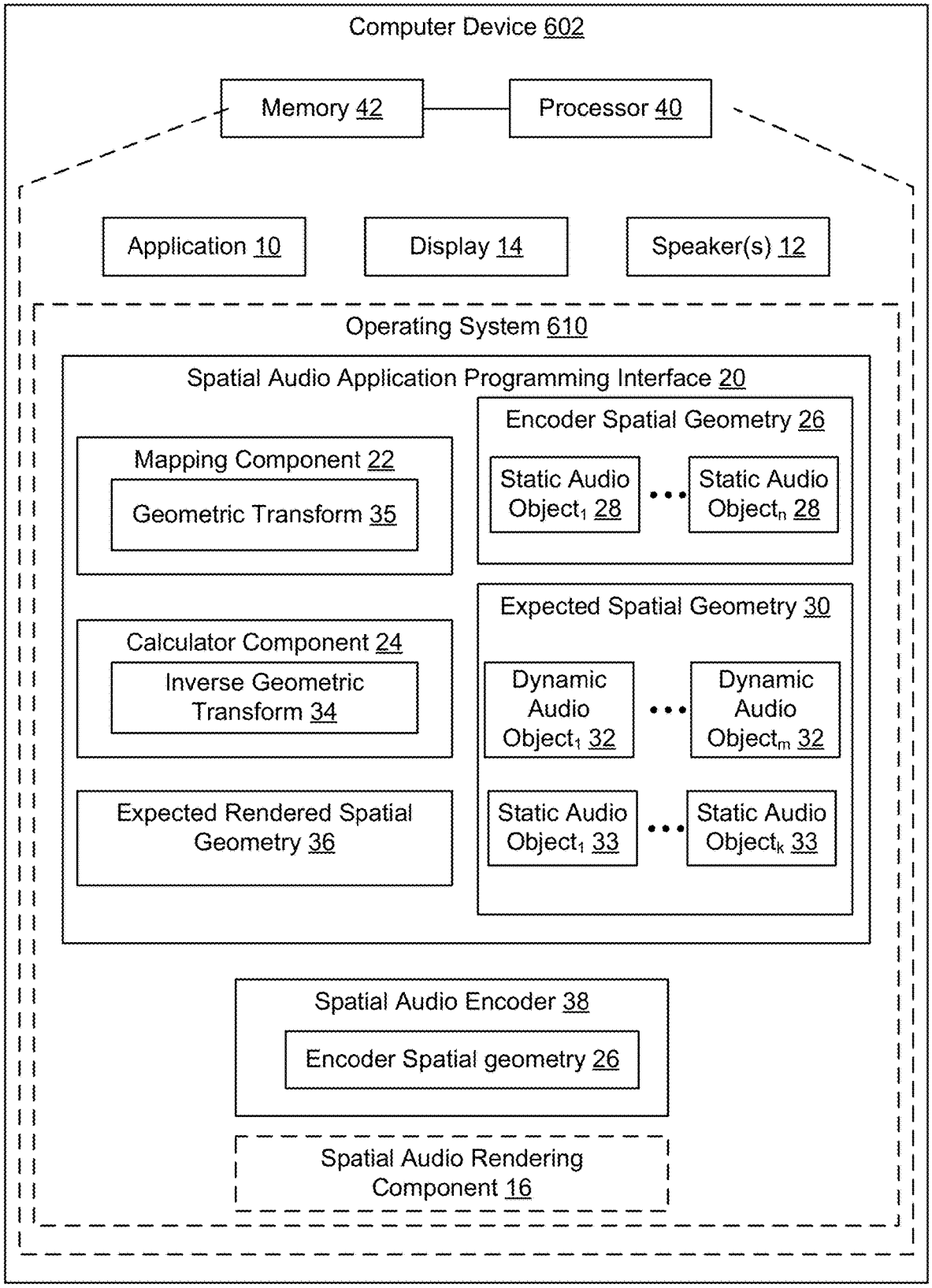
FIG. 6 is a schematic block diagram of an example device in accordance with an implementation of the present disclosure.

Referring now to FIG. 6, an example computer device 602 for compensating for warping of 3D spatial audio may include an operating system 610 executed by processor 40 and/or memory 42 of computer device 602. As used herein, 3D spatial audio may include an ability to place audio sources about a listener in three dimensions, e.g., using x, y, z coordinates relative to the listener.

Computer device 602 may include one or more applications 10 executed or processed by processor 40 and/or memory 42 of computer device 602. Memory 42 of computer device 602 may be configured for storing data and/or computer-executable instructions defining and/or associated with operating system 610, and processor 40 may execute operating system 610. An example of memory 42 can include, but is not limited to, a type of memory usable by a computer, such as random access memory (RAM), read only memory (ROM), tapes, magnetic discs, optical discs, volatile memory, non-volatile memory, and any combination thereof. An example of processor 40 can include, but is not limited to, any processor specially programmed as described herein, including a controller, microcontroller, application specific integrated circuit (ASIC), field programmable gate array (FPGA), system on chip (SoC), or other programmable logic or state machine.

Computer device 602 may include any mobile or fixed computer device, which may be connectable to a network. Computer device 602 may be, for example, a computer device such as a desktop or laptop or tablet computer, a cellular telephone, a gaming device, a mixed reality or virtual reality device, a music device, a television, a navigation system, a camera, a personal digital assistant (PDA), or a handheld device, or any other computer device having wired and/or wireless connection capability with one or more other devices.

Application 10 may allow a user to develop spatial audio content. For example, a user may develop spatial audio content for a location, such as a room, that may be a physical or virtual location. Application 10 may allow a user to specify the room, for example, by inputting a room size, a number of static audio objects to place in the room, a number of dynamic audio objects to place in the room, and/or locations of the static and dynamic audio objects in the room.

An example user may include a developer writing a game. The developer may want an immersive audio experience and may use application 10 to access spatial audio API 20 to place sounds about a listener (e.g., a gamer playing the game) to improve an experience of the game. The developer may want the gamer to hear a gunshot off to the left on the horizon, or to hear footsteps of someone walking up behind them, or hear a voice of someone up on a balcony, and may use audio as the only cue (or in combination with a visual cue) to the gamer to look in the direction of the sound. In each scenario, the sound may have a 3-Dimensional position relative to the listener (e.g., a point of view of the gamer or a character playing the game). Sound objects, usually mono-audio samples of the gunshot, the footsteps, or the spoken words, may be stored the memory 42, e.g., on a hard drive. The sound itself is generally a sound file and has no spatial information. Since the position and orientation of the listener changes dynamically during gameplay, only at the moment of playback is the position of the sound relative to the listener determined. As such, sound is played by spatial audio API 20 based on the specified x, y, z coordinates specified. If the listener (e.g., point of view of the gamer or character playing the game) is moving while sounds are playing, or if the sound is moving, the coordinates of the playback for the sound are updated dynamically in real time or near real time. As such, by using spatial audio API 20, the developer does not need to think about how the audio is spatialized. The developer may do pre-processing of the sound to provide distance decay, if not provided by the encoder in question, or if the developer wants to provide other effects like Doppler effect on a moving sound.

Application 10 may also allow a user to experience spatial audio. For example, a user of application 10 may include a listener who experiences the immersive 3D audio during gameplay when listening on a device and/or environment that supports spatial 3D audio. The user may hear the gunshot on the ridge to the left, the footsteps walking behind them, the bad guy talking up on the balcony, and know exactly where that sound is coming from.

Other uses of application 10 may include virtual surround sound (VSS) using a head-related transfer function (HRTF) spatial encoder to place virtual speakers about a listener over headphones. The static objects may be virtualized into HRTF so the user may experience surround sound over headphones while watching a movie that was rendered in surround sound, or even full spatial audio of a movie with authored spatial audio or a game with spatial audio.

Application 10 may communicate with at least one spatial audio application programming interface (API) 20. Spatial audio API 20 may allow for the playback of audio via, for example, one or more speakers 12, as either a static audio object assigned to any of the available static audio objects and/or dynamic audio objects generated by two or more static audio objects based on corresponding x, y, z position data.

Spatial audio API 20 may expose any spatial geometry, such as normalized spatial geometry 100 and/or physical room spatial geometry 200. Spatial geometries may include a specific layout of static audio objects relative to a listener as defined either by vertical and horizontal angles and distance to the listener, or by providing a room width, depth and height, along with x, y, z coordinates of the static audio objects within the volumetric space relative to the listener. Spatial geometries may be defined by requirements from an encoder. As such, a spatial geometry may vary from encoder to encoder. In addition, spatial audio API 20 may expose a common spatial geometry independent of any underlying spatial geometry requirements from encoders. Spatial audio API 20 may also expose a spatial geometry specified by a user (e.g., specifying the physical spatial geometry of the volumetric space which the audio will be consumed). When a user specifies a spatial geometry, spatial audio API 20 may also continue to expose a common spatial geometry and spatial audio API 20 may perform additional mapping between the common spatial geometry and the user defined spatial geometry prior to mapping to an encoder spatial geometry.

Spatial audio API 20 may accept room geometry input from one or more applications 10 and may process the room geometry input into a specific spatial audio encoder 38.

Spatial audio API 20 may communicate with a spatial audio encoder 38 that defines an encoder spatial geometry 26. The encoder spatial geometry 26 may include a specific layout of a plurality of static audio objects 28 relative to a listener. The encoder spatial geometry 26 may be defined by vertical and horizontal angles of the static audio objects 28 and a relative distance from the static audio objects 28 to a listener. The encoder spatial geometry 26 may also be defined by providing a room width, depth, and height, and corresponding x, y, z coordinates of the static audio objects 28 within the volumetric space relative to a listener.

Spatial audio API 20 may also determine an expected spatial geometry 30 of the room specified by application 10. For example, spatial audio API 20 may receive the geometry of the room from spatial audio API 20.

Spatial audio API 20 may have a mapping component 22 that maps the positions of the dynamic audio objects 32 of the expected spatial geometry 30 directly to positions of static audio object 28 in the encoder spatial geometry 26 when the x, y, z positions of the dynamic audio objects 32 align with the documented x, y, z positions of the static audio objects 28. The mapping occurs regardless of any differences in spatial geometries between the encoder spatial geometry 26 and the expected spatial geometry 30. Differences in static audio objects positions between geometries may cause stretching and compression (e.g., warping) of coordinate space between any various static audio objects, which may occur in three dimensional space as well. As such, a geometric transform 35 may be identified that defines a geometric warping between the expected spatial geometry 30 and the encoder spatial geometry 26. In one implementation, geometric transform 35 may be predicted by defining a geometry which corresponds to the encoder spatial geometry 26.

For example, if two static objects are closer together, the space between them may be compressed during the mapping, however, those two static audio objects may also be further away from the listener, so the space may be stretched as well. Another example may include the distance remains the same where no stretching or compression occurs. Other examples may include one of the static audio objects is closer or further apart to the other, but at the same time one static object is closer to the listener while the other is further away. For example, in a two dimensional case, there may be a listener and two static objects with a potential for any combination of compression, stretching, and/or same on each of the line segments between the static objects and/or the static objects and the listener. In the 3D space, there may be six line segments forming a "pyramid" of a mesh between three static objects and a listener, where each segment may stretch, compress, and/or stay the same. As such, a complex 3D warping of the space contained within the mesh zone may be created.

When the relative positions (e.g., angles and/or distances) of the static audio objects in one model do not match the angles and positions of the corresponding static audio objects in a second model, but the requirement of volumetric coordinates x, y, z and corresponding static audio objects remain matched, a geometric warping of the coordinates between the two models occurs.

Warping may cause both spatial and temporal distortions when perceived over time. Spatial warping may be evidenced by a dynamic audio object placed at a specific distance and a specific angle from a listener in the first model and the dynamic audio object is also placed at the same x, y, z coordinates in the second model, but with different distance and/or angle than was originally authored in the first model. Temporal distortions may be evidenced by an animated path of a dynamic audio object over time, which in the first model may be authored on a path that traverses a perfect circle at a constant velocity and constant radius form a listener, but due to geometry warping, while still being placed at the same x, y, z positions over time, no longer has a constant velocity or a constant radius from the listener.

In addition, spatial audio API 20 may also include a calculator component 24 that calculates an inverse geometric transform 34 that compensates for a geometric warping that may occur during the mapping of the dynamic audio objects 32 in the expected spatial geometry 30 to static audio objects 28 in the encoder spatial geometry 26.

Spatial audio API 20 may apply the inverse geometric transform 34 to the dynamic audio objects 32 and generate an expected rendered spatial geometry 36. The expected rendered spatial geometry 36 may include new positions for the dynamic audio objects 32 in the expected rendered spatial geometry 36 so that the new positions are encoded based on the requirements of the encoder spatial geometry 26. The expected rendered spatial geometry 36 may correct for geometric warping caused by differences between the encoder spatial geometry 26 and the expected spatial geometry 30.

For example, a modeled sound may be created at static audio object 33 in an expected spatial geometry 30. When the modeled sound is produced in the encoder spatial geometry 26, the actual sound outputted by one or more speakers 12 may differ from the modeled sound due to geometric warping that may have occurred because of differences between the encoder spatial geometry 26 and the expected spatial geometry 30. The expected rendered spatial geometry 36 may be used by spatial audio API 20 when outputting the modeled sound, for example, through one or more speakers 12 so that the actual sound outputted by the speakers 12 corrects for the geometric warping between the encoder spatial geometry 26 and the expected spatial geometry 30.

Spatial audio API 20 may expose the expected rendered spatial geometry 36 to application 10. Thus, application 10 may receive an expected rendered spatial geometry 36 that maintains an intent of the user while compensating for geometric warping based on the encoder spatial geometry 26 of the spatial audio encoder 38. In an implementation, spatial audio rendering component 16 may render the spatial audio during playback of the rendered spatial geometry 36. Spatial audio rendering component 16 may be on computer device 602 or another external device.

Figure 7:
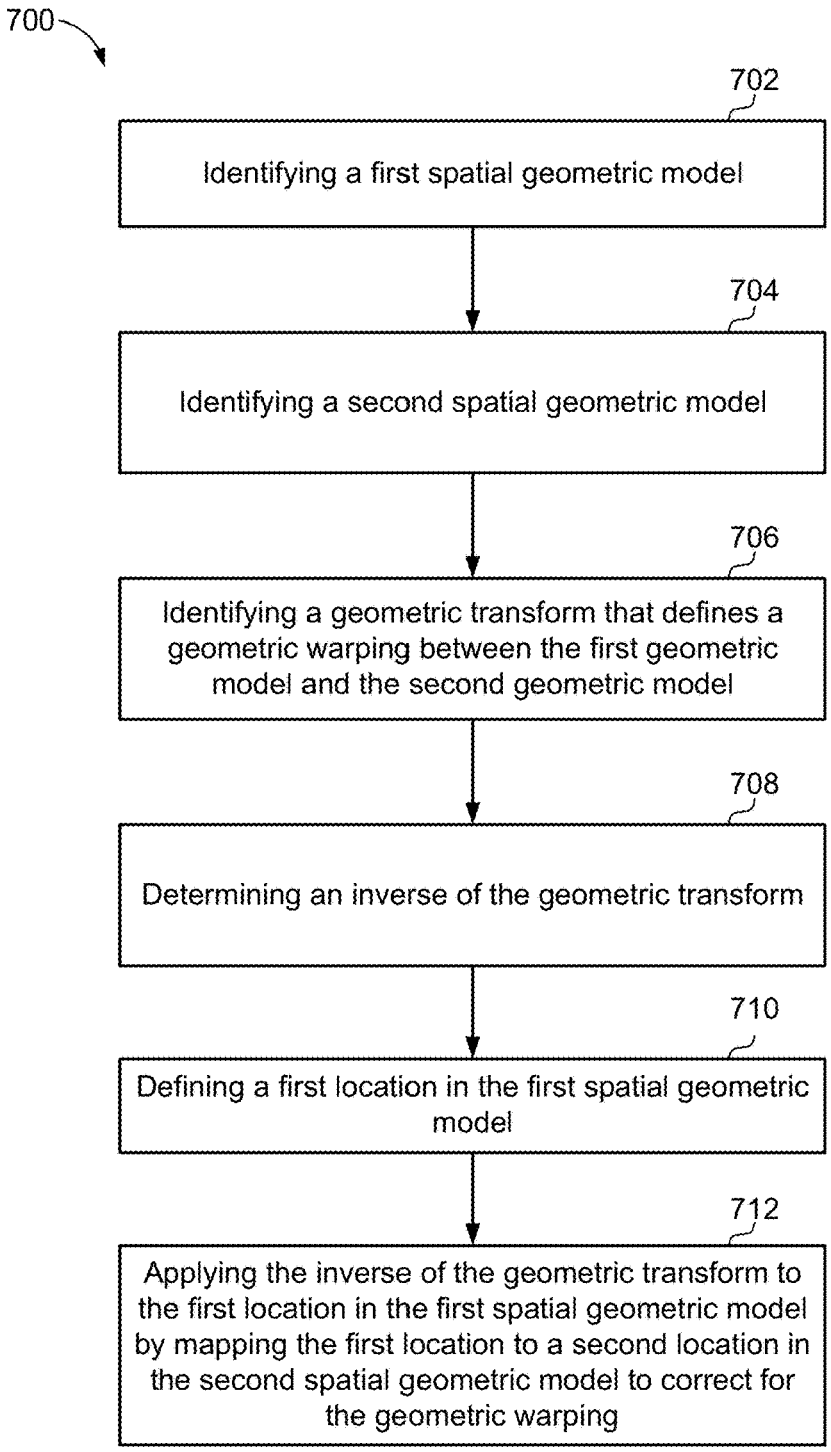
FIG. 7 is a flow chart of a method for correcting warping in spatial audio in accordance with an implementation of the present disclosure.

Referring now to FIG. 7, a method 700 of correcting warping in spatial audio may be executed by an operating system 610 (FIG. 1) on computer device 602 (FIG. 1).

At 702, method 700 may include identifying a first spatial geometric model. The first spatial geometric model may represent how sound may be produced in a first volumetric space. In addition, the first spatial geometric model may include a first set of static audio objects positioned relative to a fixed point. For example, the front-left audio object might be at position −10, −15, 0, within a range of −15 to 15 for each x, y, z coordinate. In an implementation, the first spatial geometric model may be the expected spatial geometry 30 (FIG. 1) generated based on the received room geometry input from application 10 (FIG. 1). As such, a user of application 10 may define the range of the coordinate positions for the static audio objects and/or may define a geometry for the first spatial geometric model.

At 704, method 700 may include identifying a second spatial geometric model. The second spatial geometric model may represent how sound may be produced in a second volumetric space that may be different from the first volumetric space. The second spatial geometric model may also include a second set of static audio objects positions relative to a fixed point. Each of the static audio objects within the second geometric model may be identified with coordinate positions within a second range of positions. For example, the fixed point may be a listener represented at location (0, 0, 0) and the second geometric model may identify a range of valid positions for the second set of static audio objects relative to the listener. The range of valid positions for the second set of static audio objects may be different from the range of valid positions for the static audio objects in the first geometric model. As such, the geometric relationship of the second geometric model may be different from the geometric relationship of the first geometric model. For example, the fixed point may be a listener represented at location (0,0,0) and the first geometric model may identify a range of valid positions for the static audio objects relative to the listener. An example range may include −1 to 1 for each x, y, z position for the static audio object, where one unit equals one meter. In an implementation, the second spatial geometric model may be the encoder spatial geometry 26 (FIG. 1) specified by spatial audio encoder 38 (FIG. 1).

At 706, method 700 may include identify a geometric transform that defines a geometric warping between the first geometric model and the second geometric model. Spatial audio API 20 (FIG. 1) may identify geometric transform 35 (FIG. 1). For example, a front-left speaker in the first geometric model may be positioned at −1, −1, 0, with a range of −1 to 1 for each x, y, z coordinate and a front-left speaker in the second geometric model may be at position −10, −15, 0, with a range of −15 to 15 for each x, y, z coordinate. In the first geometric model, the front-left speaker may be positioned at 45 degrees to the left of the listener and in the second geometric model, the front-left speaker may be positioned at 25 degrees. A warping may occur because the label speaker positions are aligned such that a point rendered at a same position of each speaker in the first geometric model will translate to the same position of that speaker in the second geometric model. As such, the point −1, 1, 0 in the first geometric model translates to point −10, −15, 0, in the example described, and the relative difference in position with respect to the listener defines one dimension of the warping, which is determined for all corresponding points between the models.

At 708, method 700 may include determining an inverse of the geometric transform that compensates for the geometric transform. For example, spatial audio API 20 may calculate an inverse of geometric transform 34 that compensates for a geometric warping that may occur between the first spatial geometric model and the second spatial geometric model. In an implementation, geometric transform 35 may be a prediction of the second spatial geometric model. The prediction may be based on, for example, user input or requirements from an encoder. Spatial audio API 20 may place points into the prediction of the second spatial geometric model and transform the placed points into the first spatial geometric model to calculate the inverse geometric transform 34.

At 710, method 700 may include defining a first location in the first spatial geometric model. The first location may relate to a dynamic audio object 32 (FIG. 1) in the expected spatial geometry 30. Spatial audio API 20 may identify the dynamic audio object 32, for example, by room geometry input received by application 10. In an implementation, a user of application 10 may place the dynamic audio object 32 in the expected spatial geometry 30.

At 712, method 700 may include applying the inverse of the geometric transform to the first location in the first spatial geometric model by mapping the first location to a second location in the second geometric model to correct for the geometric warping. For example, spatial audio API 20 may map the position of the dynamic audio objects 32 of the first spatial geometric model directly to positions of static audio objects 28 in the second spatial geometric model when the dynamic audio objects 32 x, y, z positions align with the documented x, y, z positions of the static audio objects 28.

Figure 8:
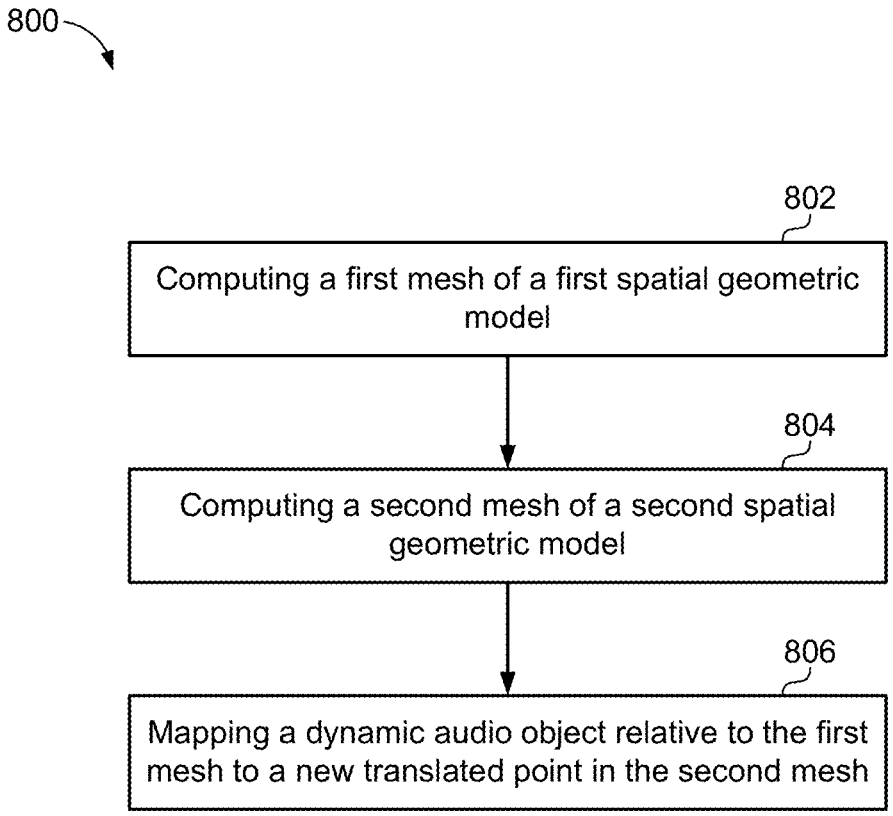
FIG. 8 is a flow chart of a method for mapping a dynamic audio object in accordance with an implementation of the present disclosure.
Figure 9A:
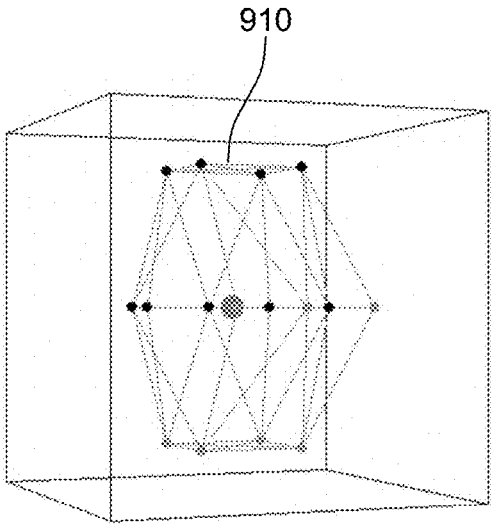
FIGS. 9A and 9B illustrate example meshes in accordance with an implementation of the present disclosure.
Figure 9B:
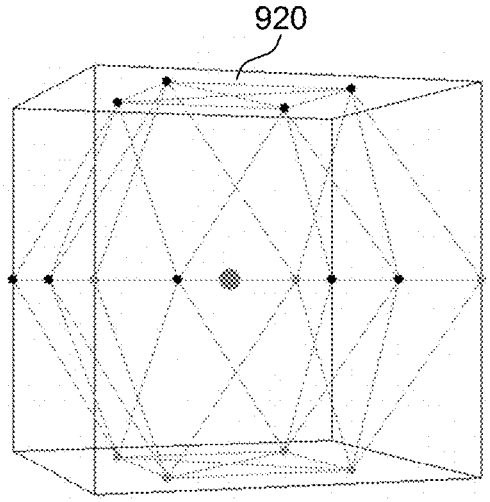

Referring now to FIGS. 8, 9A, and 9B, a method 800 (FIG. 8) for mapping a dynamic audio object between a first mesh (FIG. 9A) and a second mesh (FIG. 9B) associated with different spatial geometries may be executed by an operating system 610 (FIG. 1) on computer device 602 (FIG. 1). The method 800 is one example of a specific implementation of the present disclosure to compensate for warping between different spatial geometries in spatial audio.

At 802, method 800 may include computing a first mesh of a first spatial geometric model. For example, spatial audio API 20 (FIG. 1) may compute a first mesh in the form of a surrounding mesh of the expected spatial geometry 30 (FIG. 1) for the static audio objects 33 in the expected spatial geometry 30.

In an implementation, prior to computing the surrounding mesh, spatial audio API 20 may determine a count of the static audio objects 28 in the encoder spatial geometry 26 and a count of the static audio objects 33 in the expected spatial geometry 30 and take the greater of the two. For any missing static audio objects in the encoder spatial geometry 26 and/or the expected spatial geometry 30, spatial audio API 20 may generate positions which are symmetric to existing static audio objects in the corresponding geometry. For example, if one geometry has a center back static audio object, but the other geometry does not have a center back static audio object, spatial audio API 20 may generate a static audio object for the center back directly midpoint between back right and back left static objects for the geometry that does not have a center back static audio object. Another example may include if one geometry has lower speakers and the other geometry does not have lower speakers, spatial audio API 20 may generate a mirror of the top speakers by reflecting the positions of the top speakers in the inverse plane. When spatial audio API 20 is generating any additional static audio objects, symmetric angels and distances may be maintained.

Spatial audio API 20 may generate a mesh for the expected spatial geometry 30 using all the static audio objects 33 in a listener plane to form a list of line segments. One implementation may include starting at any static object in listener plane, connect to next object. An example set of surround speakers may include, FrontLeft→FrontCenter→FrontRight→SideRight→BackRight→BackCenter→BackLeft→SideLeft→FrontLeft.

For each segment defined, spatial audio API 20 may connect to a corresponding upper speaker nearest the segment. For example, segment FrontLeft→FrontCenter may connect to TopFrontLeft, which defines a single face of the mesh. If lower speakers are present, each segment may connect again to lower speakers, so Front→Left→FrontCenter→BottomFrontLeft. Top speakers may be connected to each other, or to a central generated center point to maintain polar symmetry, and down to surrounding speakers. By connecting the top and bottom speakers as described above, a solid mesh made up of just triangles may be created which completely surrounds the listener. An example mesh 910 of the expected spatial geometry 30 is illustrated in FIG. 9A.

At 804, method 800 may include computing a second mesh of a second spatial geometric model. Spatial audio API 20 may compute a second mesh in the form of a surrounding mesh of the encoder spatial geometry 26 (FIG. 1) for the static audio objects 28 in the encoder spatial geometry 26.

In one implementation, spatial audio API 20 may use all the static audio objects 28 in a listener plane to form a list of line segments. For example, spatial audio API 20 may start at any static audio object 28 in listener plane, connect to next object. An example set of surround speakers may include, FrontLeft→FrontCenter→FrontRight→SideRight→BackRight→BackCenter→BackLeft→SideLeft→FrontLeft.

For each segment defined, spatial audio API 20 may connect to a corresponding upper speaker nearest the segment. For example, segment FrontLeft→FrontCenter may connect to TopFrontLeft, which defines a single face of the mesh. If lower speakers are present, each segment may connect again to lower speakers, so Front→Left→FrontCenter→BottomFrontLeft. Top speakers may be connected to each other, or to a central generated center point to maintain polar symmetry and down to surrounding speakers. By connecting the top and bottom speakers as described above, a solid mesh made up of just triangles may be created which completely surrounds the listener. An example mesh 920 of the encoder spatial geometry is illustrated in FIG. 9B.

As such, the first mesh and the second mesh each have a same number of faces, which directly correspond to a same ordered mesh face on the other mesh. Thus, if face 1 on mesh 1 is defined by FrontLeft, FrontCenter and TopFrontLeft, then face 1 on mesh 2 is defined the same by FrontLeft, FrontCenter and TopFrontLeft.

At 806, method 800 may include mapping a dynamic audio object relative to the first mesh to a new translated point in the second mesh. For example, spatial audio API 20 may map a dynamic audio object 32 from the expected spatial geometry 30 to a new translated point in the encoder spatial geometry 26.

One implementation for mapping a dynamic audio object 32 (D1) from the first mesh to a new translated point (D2) in the second mesh may include spatial audio API 20 defining a first line (L1) in the first mesh from origin (0, 0, 0) to D1 and computing an intersection face (face F1) of the first mesh by using the first line L1 and an intersection point P1. Spatial audio API 20 may also identify a second face (F2) in the second mesh that directly corresponds to face F1 in the first mesh. Spatial audio API 20 may map Point P1 in face F1 into a new mapped intersection point P2 in face F2 while maintaining relative position face F1 and face F2. Spatial audio API 20 may compute scaleD1=(magnitude of D1)/(magnitude of P1). Spatial audio API 20 may also compute D2=P2+(magnitude of P2)*scaleD1. Magnitude may include the length of the vector from an origin location (0, 0, 0) to the point (x, y, z).

Figure 10B:
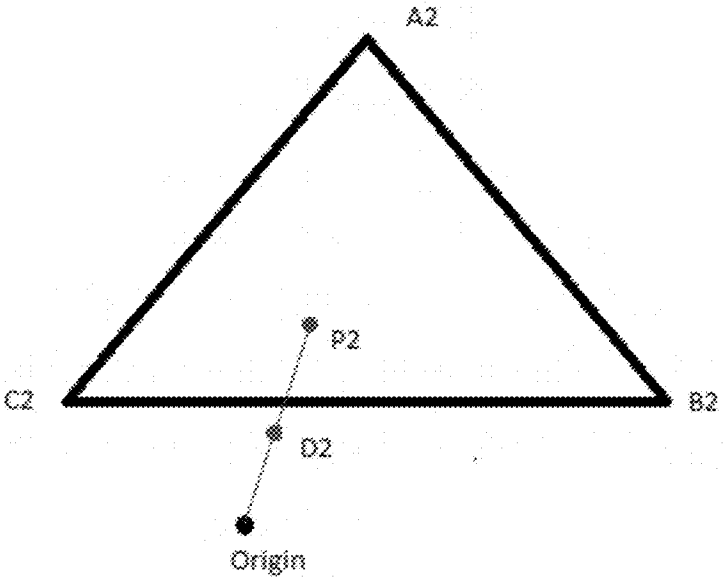
FIGS. 10A and 10B illustrate example mapped values in accordance with an implementation of the present disclosure.
Figure 10A:
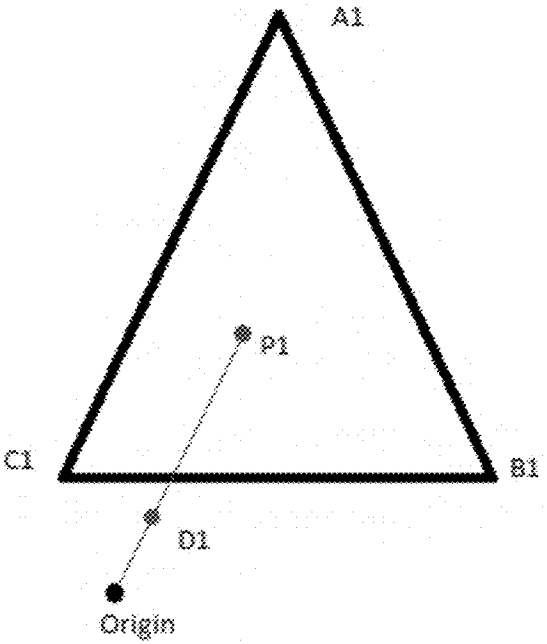
Figure 11A:
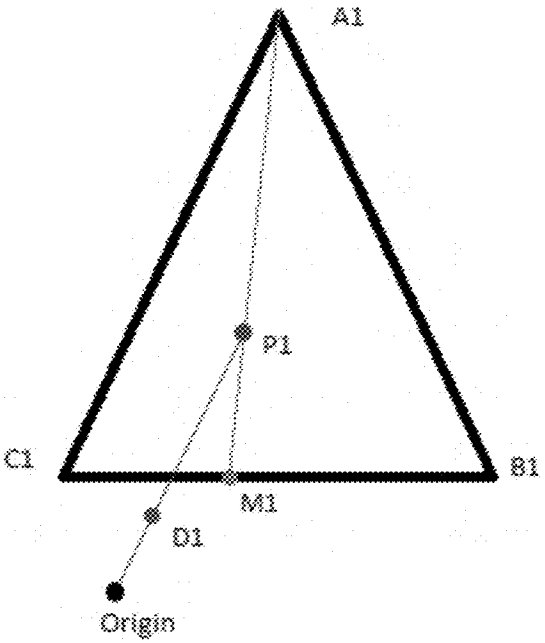
FIGS. 11A and 11B illustrate example mapped values in accordance with an implementation of the present disclosure.
Figure 11B:
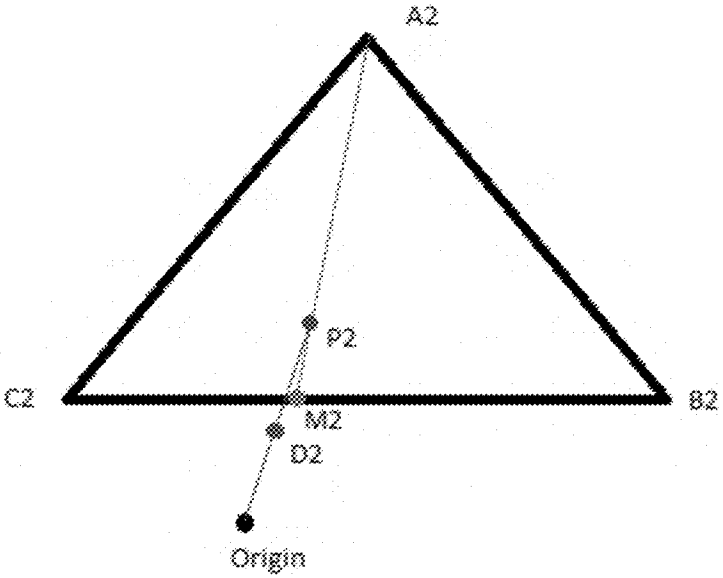

One implementation for the mapping point P1 to P2 may include spatial audio API 20 defining a triangle for first face in the first mesh as A1, B1, C1, where point P1 is the intersection point contained within the triangle for the first face, as illustrated in FIG. 10A. Intersection point P1 may be mapped to an intersection point P2 and scaled to get point D2, as illustrated in FIG. 11B. Spatial audio API 20 may also define a triangle for second face in the second mesh as A2, B2, C2, as illustrated in FIG. 10B. Spatial audio API 20 may also define line A as point A1 to point P1 and line B as Point B1 to point C1 and may find the intersection of line A and line B at point M1, as illustrated in FIG. 11A. Line M1 will line on the line segment B1→C1. Spatial audio API 20 may compute scaleB1 as (magnitude(B1→M1)/(magnitude(B1–C1). Spatial audio API 20 may compute scaleA1 as (magnitude(A1→P1)/(magnitude(A1→M1). Spatial audio API 20 may compute M2=B2+(magnitude(B2→C2)*scaleB1). Spatial audio API 20 may compute P2=A2+(magnitude (A2→M2)*scaleA1). Spatial audio API 20 may also compute D2=P2+(magnitude of P2)*scaleD1.

Figure 12:
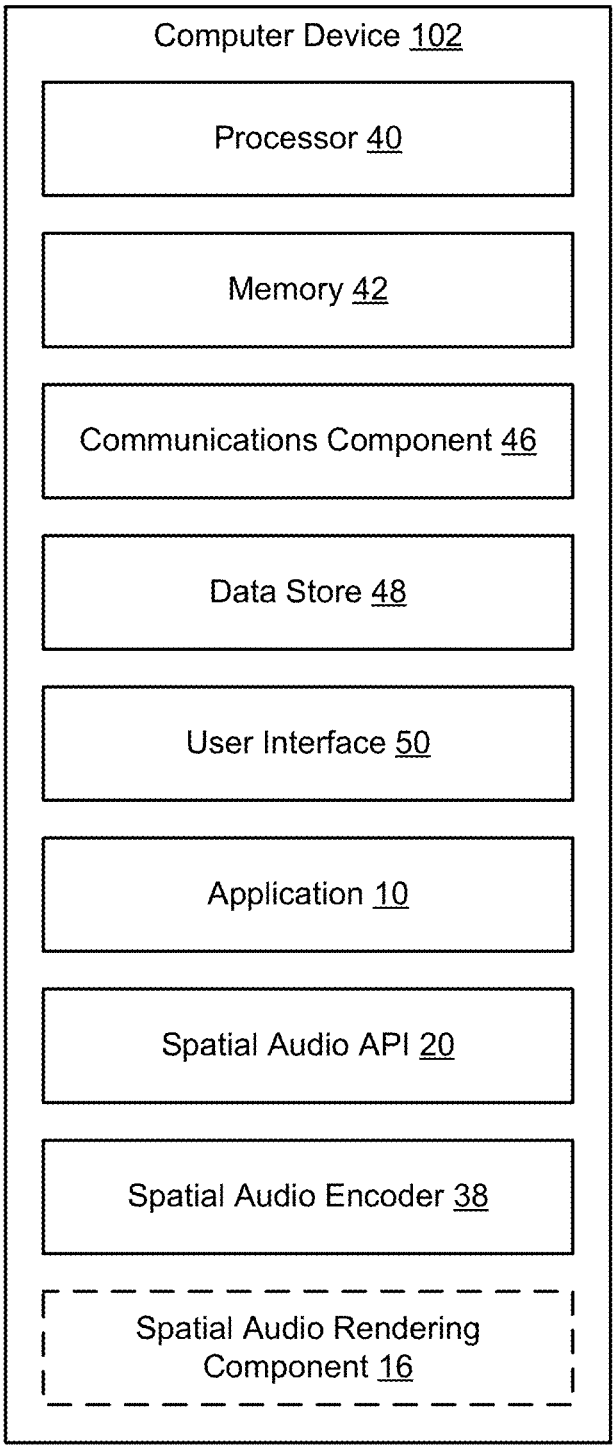
FIG. 12 is a schematic block diagram of an example device in accordance with an implementation of the present disclosure.

Referring now to FIG. 12, illustrated is an example computer device 602 in accordance with an implementation, including additional component details as compared to FIG. 1. In one example, computer device 602 may include processor 40 for carrying out processing functions associated with one or more of components and functions described herein. Processor 40 can include a single or multiple set of processors or multi-core processors. Moreover, processor 40 can be implemented as an integrated processing system and/or a distributed processing system.

Computer device 602 may further include memory 42, such as for storing local versions of applications being executed by processor 40. Memory 42 can include a type of memory usable by a computer, such as random access memory (RAM), read only memory (ROM), tapes, magnetic discs, optical discs, volatile memory, non-volatile memory, and any combination thereof. Additionally, processor 40 and memory 42 may include and execute operating system 610 (FIG. 1).

Further, computer device 602 may include a communications component 46 that provides for establishing and maintaining communications with one or more parties utilizing hardware, software, and services as described herein. Communications component 46 may carry communications between components on computer device 602, as well as between computer device 602 and external devices, such as devices located across a communications network and/or devices serially or locally connected to computer device 602. For example, communications component 46 may include one or more buses, and may further include transmit chain components and receive chain components associated with a transmitter and receiver, respectively, operable for interfacing with external devices.

Additionally, computer device 602 may include a data store 48, which can be any suitable combination of hardware and/or software, that provides for mass storage of information, databases, and programs employed in connection with implementations described herein. For example, data store 48 may be a data repository for applications 10 (FIG. 1), spatial audio API 20 (FIG. 1), spatial audio encoder 38 (FIG. 1) and/or spatial audio rendering component 16 (FIG. 1).

Computer device 602 may also include a user interface component 50 operable to receive inputs from a user of computer device 602 and further operable to generate outputs for presentation to the user. User interface component 50 may include one or more input devices, including but not limited to a keyboard, a number pad, a mouse, a touch-sensitive display, a navigation key, a function key, a microphone, a voice recognition component, any other mechanism capable of receiving an input from a user, or any combination thereof. Further, user interface component 50 may include one or more output devices, including but not limited to a display, a speaker, a haptic feedback mechanism, a printer, any other mechanism capable of presenting an output to a user, or any combination thereof.

In an implementation, user interface component 50 may transmit and/or receive messages corresponding to the operation of applications 10, spatial audio API 20, spatial audio encoder 38 and/or spatial audio rendering component 16. In addition, processor 40 executes applications 10, spatial audio API 20, spatial audio encoder 38, and/or spatial audio rendering component 16, and memory 42 or data store 48 may store them.

As used in this application, the terms "component," "system" and the like are intended to include a computer-related entity, such as but not limited to hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computer device and the computer device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets, such as data from one component interacting with another component in a local system, distributed system, and/or across a network such as the Internet with other systems by way of the signal.

Furthermore, various implementations are described herein in connection with a device (e.g., computer device 602), which can be a wired device or a wireless device. A wireless device may be a cellular telephone, a satellite phone, a cordless telephone, a Session Initiation Protocol (SIP) phone, a wireless local loop (WLL) station, a personal digital assistant (PDA), a handheld device having wireless connection capability, a computer device, a mixed reality or virtual reality device, or other processing devices connected to a wireless modem.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Various implementations or features may have been presented in terms of systems that may include a number of devices, components, modules, and the like. It is to be understood and appreciated that the various systems may include additional devices, components, modules, etc. and/or may not include all of the devices, components, modules etc. discussed in connection with the figures. A combination of these approaches may also be used.

The various illustrative logics, logical blocks, and actions of methods described in connection with the embodiments disclosed herein may be implemented or performed with a specially-programmed one of a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computer devices, e.g., a combination of a DSP and a microprocessor, a plurality of microprocessors, one or more microprocessors in conjunction with a DSP core, or any other such configuration. Additionally, at least one processor may comprise one or more components operable to perform one or more of the steps and/or actions described above.

Further, the steps and/or actions of a method or algorithm described in connection with the implementations disclosed herein may be embodied directly in hardware, in a software module executed by a processor, or in a combination of the two. A software module may reside in RAM memory, flash memory, ROM memory, EPROM memory, EEPROM memory, registers, a hard disk, a removable disk, a CD-ROM, or any other form of storage medium known in the art. An exemplary storage medium may be coupled to the processor, such that the processor can read information from, and write information to, the storage medium. In the alternative, the storage medium may be integral to the processor. Further, in some implementations, the processor and the storage medium may reside in an ASIC. Additionally, the ASIC may reside in a user terminal. In the alternative, the processor and the storage medium may reside as discrete components in a user terminal. Additionally, in some implementations, the steps and/or actions of a method or algorithm may reside as one or any combination or set of codes and/or instructions on a machine readable medium and/or computer readable medium, which may be incorporated into a computer program product.

In one or more implementations, the functions described may be implemented in hardware, software, firmware, or any combination thereof. If implemented in software, the functions may be stored or transmitted as one or more instructions or code on a computer-readable medium. Computer-readable media includes both computer storage media and communication media including any medium that facilitates transfer of a computer program from one place to another. A storage medium may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs usually reproduce data optically with lasers. Combinations of the above should also be included within the scope of computer-readable media.

While implementations of the present disclosure have been described in connection with examples thereof, it will be understood by those skilled in the art that variations and modifications of the implementations described above may be made without departing from the scope hereof. Other implementations will be apparent to those skilled in the art from a consideration of the specification or from a practice in accordance with examples disclosed herein.

What is claimed is:

1. A computer device, comprising:

a memory to store data and instructions;

a processor in communication with the memory;

an operating system in communication with the memory and the processor, wherein the operating system is operable to:

identify a geometric transform that defines a geometric warping between a first spatial geometric model that represents how sound is produced in a first volumetric space and a second spatial geometric model that represents how sound is produced in a second volumetric space different from the first volumetric space, wherein the first spatial geometric model correlates to a normalized room geometry and the second spatial geometric model correlates to a physical room geometry;

determine an inverse of the geometric transform that compensates for the geometric transform;

compute a first mesh of the first spatial geometric model;

compute a second mesh of the second spatial geometric model;

determine a first face in the first mesh, wherein a volumetric space defined by the relationship of the first face to an origin contains a first location;

identify a second face in the second mesh corresponding to the first face in the first mesh; and apply the inverse of the geometric transform to the first location in the first spatial geometric model by directly mapping the first location in the first face to a second location in the second face in the second spatial geometric model to correct for the geometric warping while maintaining a relative position of the first location in the first face and the second face to generate a dynamic audio object.

2. The computer device of claim 1, wherein the first spatial geometric model defines a first layout of static audio objects within the first volumetric space of a location relative to a fixed position, and wherein the second spatial geometric model defines a second layout of static audio objects within the second volumetric space relative to the fixed position.

3. The computer device of claim 2, wherein coordinates of the static objects in the first spatial geometric model are within a first range of positions, and wherein the coordinates of the static objects in the second spatial geometric model are within a second range of positions.

4. The computer device of claim 2, wherein the location is a physical room or a virtual room.

5. The computer device of claim 2, wherein the second spatial geometric model is based on requirements from an encoder.

6. The computer device of claim 1, wherein the operating system is further operable to:

receive room geometry input of the second spatial geometric model from a user, wherein the room geometry input includes one or more of a location size, a number of static objects to place in the location, a number of dynamic objects to place in the room, locations of the static objects, and locations of the dynamic objects.

7. The computer device of claim 1, wherein the first spatial geometric model is based on one or more of an expected room geometry, a predicted room geometry, or a described room geometry of a rendering of encoded spatial audio.

8. The computer device of claim 1, wherein the operating system is further operable to determine the inverse of the geometric transform by placing a plurality of points into a prediction of the second spatial geometric model and transforming the plurality of points into the first spatial geometric model to calculate the inverse geometric transform.

9. A method for correcting warping in spatial audio, comprising:

identifying, at an operating system executing on a computer device, a geometric transform that defines a geometric warping between a first spatial geometric model that represents how sound is produced in a first volumetric space and a second spatial geometric model that represents how sound is produced in a second volumetric space different from the first volumetric space, wherein the first spatial geometric model correlates to a normalized room geometry and the second spatial geometric model correlates to a physical room geometry;

determining, at the operating system, an inverse of the geometric transform that compensates for the geometric transform;

computing a first mesh of the first spatial geometric model;

computing a second mesh of the second spatial geometric model;

determining a first face in the first mesh, wherein a volumetric space defined by the relationship of the first face to an origin contains a first location;

identifying a second face in the second mesh corresponding to the first face in the first mesh; and applying the inverse of the geometric transform to the first location in the first spatial geometric model by directly mapping the first location in the first face to a second location in the second face in the second spatial geometric model to correct for the geometric warping while maintaining a relative position of the first location in the first face and the second face to generate a dynamic audio object.

10. The method of claim 9, wherein the first spatial geometric model defines a first layout of static audio objects within the first volumetric space of a location relative to a fixed position, and wherein the second spatial geometric model defines a second layout of static audio objects within the second volumetric space relative to the fixed position.

11. The method of claim 10, wherein coordinates of the static objects in the first spatial geometric model are within a first range of positions, and wherein the coordinates of the static objects in the second spatial geometric model are within a second range of positions.

12. The method of claim 10, wherein the location is a physical room or a virtual room.

13. The method of claim 10, wherein the second spatial geometric model is based on requirements from an encoder.

14. The method of claim 9, further comprising:

receiving room geometry input of the second spatial geometric model from a user, wherein the room geometry input includes one or more of a location size, a number of static objects to place in the location, a number of dynamic objects to place in the room, locations of the static objects, and locations of the dynamic objects.

15. The method of claim 9, wherein the first spatial geometric model is based on one or more of an expected room geometry, a predicted room geometry, or a described room geometry of a rendering of encoded spatial audio.

16. The method of claim 9, wherein determining the inverse of the geometric transform further comprises:

placing a plurality of points into a prediction of the second spatial geometric model; and transforming the plurality of points into the first spatial geometric model to calculate the inverse geometric transform.

17. A non-transitory computer-readable medium storing instructions executable by a computer device, comprising:

at least one instruction for causing the computer device to identify a geometric transform that defines a geometric warping between a first spatial geometric model that represents how sound is produced in a first volumetric space and a second spatial geometric model that represents how sound is produced in a second volumetric space different from the first volumetric space, wherein the first spatial geometric model correlates to a normalized room geometry and the second spatial geometric model correlates to a physical room geometry;

at least one instruction for causing the computer device to determine an inverse of the geometric transform that compensates for the geometric transform;

at least one instruction for causing the computer device to compute a first mesh of the first spatial geometric model;

at least one instruction for causing the computer device to compute a second mesh of the second spatial geometric model;

at least one instruction for causing the computer device to determine a first face in the first mesh, wherein a volumetric space defined by the relationship of the first face to an origin contains a first location;

at least one instruction for causing the computer device to identify a second face in the second mesh corresponding to the first face in the first mesh; and at least one instruction for causing the computer device to apply the inverse of the geometric transform to the first location in the first spatial geometric model by directly mapping the first location in the first face to a second location in the second face in the second spatial geometric model to correct for the geometric warping while maintaining a relative position of the first location in the first face and the second face to generate a dynamic audio object.

18. The method of claim 9, further comprising:

defining a first line in the first mesh from the origin to an intersection point in the first mesh;

computing a first face of the first mesh by using the first line and the intersection point;

identifying a second face in the second mesh that directly corresponds to the first face of the first mesh; and mapping the first location in the first face to a new mapped intersection location in the second face.

19. The method of claim 18, wherein mapping the first location to the new mapped intersection location further includes applying a scale factor during the mapping.

20. The computer device of claim 1, wherein the normalized room geometry correlates to an authoring model and the physical room geometry correlates to a rendering model.

* * * * *